US006237756B1

(12) United States Patent
Caudle

(10) Patent No.: US 6,237,756 B1
(45) Date of Patent: May 29, 2001

(54) KEY STORAGE DEVICE

(76) Inventor: Scott Caudle, 17405 Monica, Detroit, MI (US) 48221

( * ) Notice: Subject to any disclaimer, the term of this patent is extended or adjusted under 35 U.S.C. 154(b) by 0 days.

(21) Appl. No.: 09/376,641

(22) Filed: Aug. 18, 1999

Related U.S. Application Data

(60) Provisional application No. 60/097,175, filed on Aug. 20, 1998.

(51) Int. Cl.[7] ..... A45C 11/32

(52) U.S. Cl. ..... 206/37.2; 206/37.4; 206/38.1; 70/456 R

(58) Field of Search ..... 206/37.2, 37.4, 206/37.1, 37.5, 37.6, 38.1; 70/456 R

(56) References Cited

U.S. PATENT DOCUMENTS 2,601,331 * 6/1952 Segal ..... 206/37.2
3,354,678 * 11/1967 Stifelman ..... 206/37.2
5,228,563 * 7/1993 Stringham ..... 206/37.2
5,487,291 * 1/1996 Volgt ..... 206/37.4

* cited by examiner

*Primary Examiner*—Luan K. Bui
(74) *Attorney, Agent, or Firm*—Charles W. Chandler

(57) ABSTRACT

Conventional keys can be stored in a flat panel for carrying in a person's pants pocket or purse. Each key is stored in a flat slot extending from one edge of the panel. A push-button on the panel can be moved along the panel surface to push the key out of the panel or to pull the key into the panel. The push-button is attached to the key by a flexible connector that has a lost motion connection to the push-button. The lost motion connection allows the key to be spaced from the panel so as to be manipulatable without interference from the panel.

3 Claims, 2 Drawing Sheets

KEY STORAGE DEVICE

This application claims the benefit of U.S. Provisional application Ser. No. 60/097,175 filed Aug. 20, 1998.

BACKGROUND OF THE INVENTION

This invention relates to a key storage device, and particularly to a key storage device having a relatively flat compact shape, whereby the device can be readily placed in a person's pocket for ready access when needed.

It is a common practice to hang keys (e.g. car keys, house keys, and safe deposit keys) on a key chain or key ring. The loose keys can rub against the interior surface of the person's pants pocket so as to possibly wear a hole in the pocket fabric. Also, the sharp edges or ends of the loose keys can penetrate the pocket fabric to generate uncomfortable pressure on the person's skin.

The present invention relates to a flat key storage device that can be placed in a person's pocket or purse without damaging the fabric or exerting an uncomfortable pressure on the person's skin. In one preferred embodiment of the invention, the key storage device comprises a flat panel structure having plural slots therein for receiving individual keys. Each key is connected to a flexible chain or wire that has a lost-motion attachment to a slidable push-button mounted on the panel.

Each push-button can be moved in one direction on the panel to eject the associated key from the panel; the flexible chain or wire allows the key to be moved a limited distance from the panel while still preventing the key from becoming permanently separated from the panel. The key can be inserted into a lock while attached to the chain or wire.

Each push-button can be moved in the opposite direction on the panel to draw the associated key back into the panel. The flexible chain or wire can be moved relative to the push-button to permit complete insertion of the key into its slot.

The invention is advantageous in that the individual keys can be stored within the panel so as to be entirely enclosed. Nevertheless, individual keys can be withdrawn a considerable distance out of the panel when it becomes necessary to use them for unlocking purposes. The keys are permanently connected to the panel, via the chain or wire, such that the keys cannot be lost or mislaid.

Further features of the invention will be apparent from the attached drawings and description of an illustrative embodiment of the invention.

DESCRIPTION OF A PREFERRED EMBODIMENT OF THE INVENTION

Figure 1:
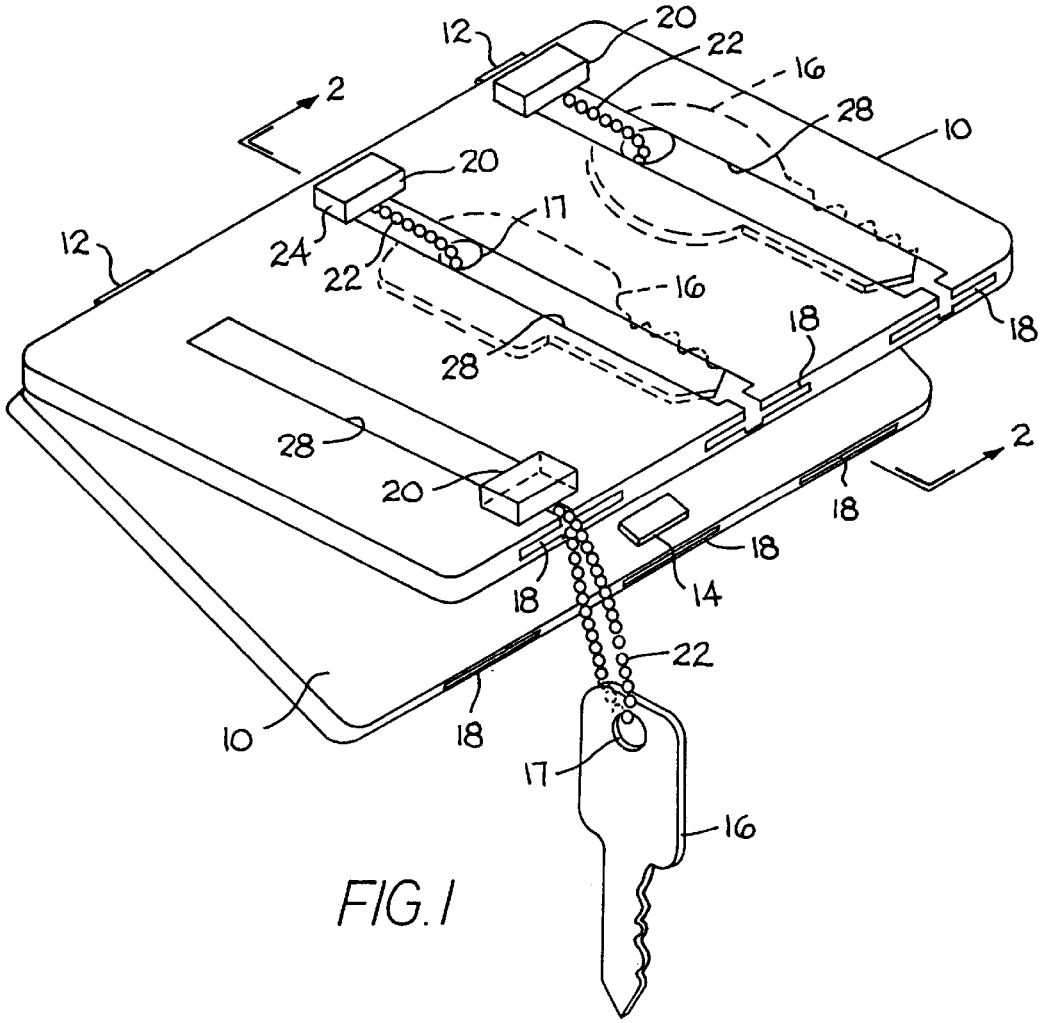
FIG. 1 is a perspective view of a key storage device constructed according to the invention.

FIG. 1 shows a preferred form of the invention. As shown in FIG. 1, the invention comprises a key storage device that includes two similarly constructed panels 10, 10 connected together by hinges 12, 12, whereby the panels can be closed against one another or separated from one another (while still being connected by hinges 12, 12). FIG. 1 shows the two panels hinged apart. The two panels will normally be closed together in a compact two-layer condition for storage in a person's pocket or purse. A patch of fibrous adhesive material 14 on the lowermost panel mates with a companion adhesive patch on the uppermost panel to releasably hold the two panels together. Materials available under the tradename VELCRO can be used for the adhesive patches. Other types of clasps or latches can be used.

Figure 7:
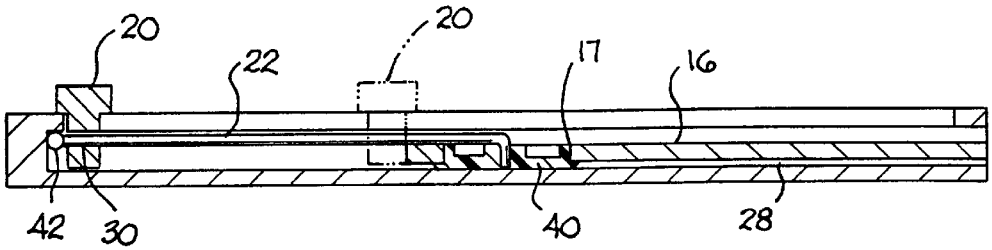
FIG. 7 is a view taken in the same direction as FIG. 2, but showing another form of the invention.

Each panel 10 is adapted to store three keys, numbered 16. The size of each panel can be increased, or decreased, to store different numbers of keys. Each key 16 is stored in an individual slot 18 in the panel. FIG. 1 shows one key 16 fully withdrawn from the uppermost panel 10, and two keys 16 fully inserted into the uppermost panel. Each key 16 is attached to a slidable push-button 20, via a flexible connector 22. As shown in FIGS. 1 through 6, the flexible connector is an articulated endless chain formed by plural beads or small balls strung on a thread or string. As shown in FIG. 7, the flexible connector is a flexible wire.

Each push-button 20 comprises an enlarged external section 24 located on the external surface of panel 10, and an internal neck section 26 extending through a relatively narrow slot 28 into the aforementioned slot 18. In the embodiment of FIGS. 1 through 6, internal neck section 26 of the push-button has a circular opening 30 that receives the upper run of flexible chain 22. The lower run of chain 22 extends within a narrow trough 32 that communicates with slot 18. Chain 22 extends loosely through the standard circular hole 17 formed in key 16, such that chain 22 forms a flexible connector between the key and push-button 20.

Push-button 20 can be manually moved along slot 28 between the two limiting positions shown in FIG. 1. In one limiting position of the push-button, the associated key 16 is fully withdrawn from the storage panel 10. In the other limiting position of the push-button, the associated key is fully enclosed in storage panel 10.

Figure 2:
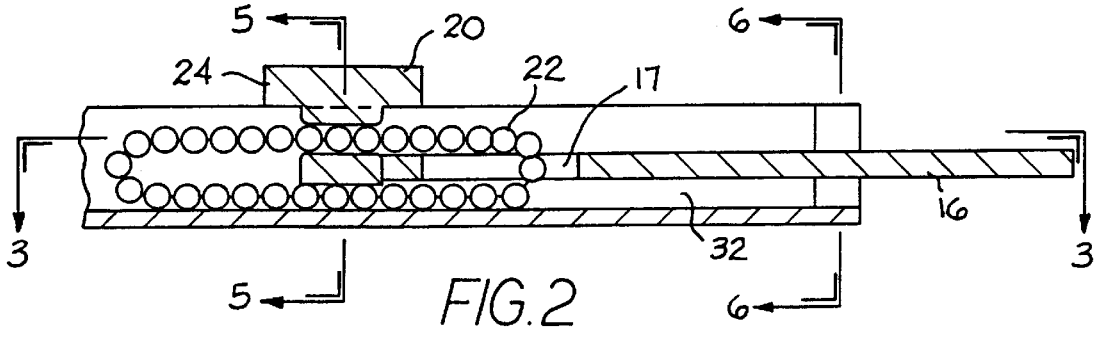
FIG. 2 is a sectional view taken on line 2—2 in FIGS. 1 and 3, showing a key in a position partially drawn out of the key storage panel.
Figure 3:
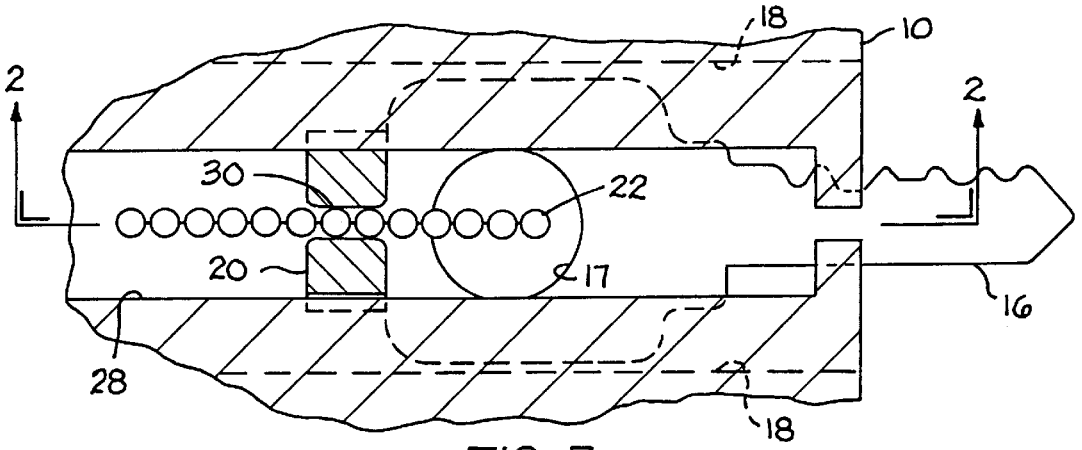
FIG. 3 is a sectional view taken on line 3—3 in FIG. 2.
Figure 4:
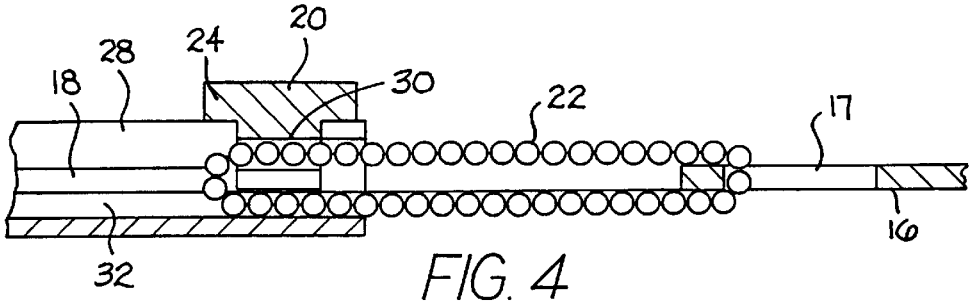
FIG. 4 is a view taken in the same direction as FIG. 2, but showing the key in a position fully withdrawn from the key storage panel.
Figure 5:
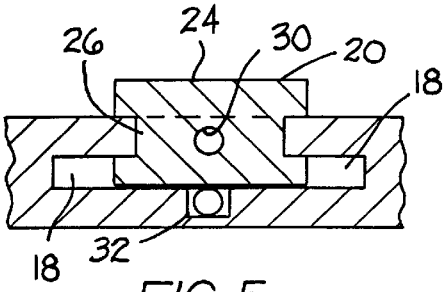
FIG. 5 is a transverse sectional view taken on line 5—5 in FIG. 2.
Figure 6:
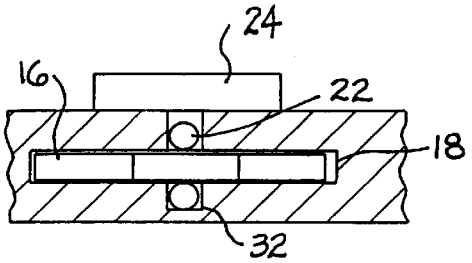
FIG. 6 is a transverse sectional view taken on line 6—6 in FIG. 2.

FIG. 2 shows push-button 20 in an intermediate position (approximately midway between the two limiting positions). Rightward movement of the push-button, from the FIG. 2 position causes the push-button to exert a pushing force on the associated key 16, whereby the key is forced substantially out of slot 18. At that point the key can be manually grasped and pulled entirely out of storage panel 10 to the exposed condition depicted in FIG. 1. Chain 22 is long enough that the exposed key can be manually manipulated in a lock without interference from panel 10. FIG. 4 shows the key fully exposed.

Push-button 20 can be retracted leftwardly to pull the key back into slot 18. When the push-button is pulled to the limit of its motion in the leftward direction, the key is fully enclosed in panel 10; flexible connector chain 22 is in a taut condition. Push-button 20 can be retained in its retracted condition by any suitable mechanism, e.g. frictional detents located on the edges of slot 28.

FIG. 7 shows a second form of the invention, wherein the flexible connector 22 is a flexible steel wire. The right end of the connector wire is anchored to a plug 40 that is frictionally seated in hole 17 of key 16. The wire extends freely through a hole 30 in push-button 20. An enlargement 42 on the wire provides a drive connection between the wire and the push-button.

When push-button 20 is moved from the FIG. 7 retracted position, there is no movement of key 16 until the push-button contacts the key. When the push-button reaches the dashed line position, further rightward motion of the push-button forces key 16 out of the key storage panel 10. Wire 22 serves the same function as chain 22 in the FIG. 1 embodiment. When push-button 20 is moved leftwardly to the retracted position, wire 22 pulls the key 16 to the FIG. 7 enclosed position.

In both forms of the invention the push-button is connected to key 16 by a flexible connector 22 that has a lost motion connection with the push-button, such that the key is spaced from the key storage panel 10 when it is fully exposed. The exposed key can be freely manipulated while still being connected to the key storage panel.

Having described my invention, I claim:

1. A key storage case for storing a plurality of keys so that a selected key can be removed from an enclosed position, comprising:

a flat storage device including a pair of similarly constructed panels having adjacent sides joined by hinge means so as to be relatively moveable between a closed parallel position, and an open position, a first fibrous adhesive patch on a first of said panels, and a second fibrous adhesive patch on the second of said panels, the first patch being releasably engageable with the second patch for releasably holding the pair of panels in said closed position;

each of said panels having a plurality of parallel key storage slots (18), each of the key storage slots having a length greater than the length of keys to be stored therein, a top wall and a bottom wall;

a push button slideably mounted on each of said key storage slots between a retracted position and an extended position, each of said push buttons comprising an enlarged external section (24) located on an external surface of its respective panel and an internal neck section (26) extending through a narrow slot (28) in the top wall of a key storage slot (18), the neck section having an opening (30) aligned with said narrow slot;

the bottom wall of each of said key storage slots, having an elongated trough (32) aligned with the corresponding key storage slot and disposed adjacent said opening (30) in the neck section;

an elongated flexible connector received in the opening (30) and extending therethrough, and having a lower run disposed in said trough (32);

each of said push buttons being manually slidable along its respective key storage slot (18) from a first position adjacent the hinged side of the panels;

each of said key storage slots having a key-receiving opening opposite the hinged side thereof;

each of said push buttons being moveable toward the opposite end of its key storage slot in which a key connected thereto is fully withdrawn from the storage slot in a motion in which the neck pushes the key from the stored position in the case; and said flexible connector having a lost motion connection with the push button whereby the key is separated from the panel when the key is withdrawn out of the key storage slot.

2. The key storage device of claim 1, wherein said flexible connector is a chain.

3. The key storage device of claim 1, wherein said flexible connector is a wire.

* * * * *